US006622895B2

(12) United States Patent
McClean et al.

(10) Patent No.: US 6,622,895 B2
(45) Date of Patent: Sep. 23, 2003

(54) DISPENSER PACKAGE FOR FLUENT PRODUCTS AND METHOD OF MANUFACTURE

(75) Inventors: Craig E. McClean, Harrisonburg, VA (US); Robert E. Harman, Perrysburg, OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 10/095,167

(22) Filed: Mar. 11, 2002

(65) Prior Publication Data

US 2002/0092880 A1 Jul. 18, 2002

Related U.S. Application Data

(62) Division of application No. 09/383,165, filed on Aug. 24, 1999, now Pat. No. 6,394,323.

(51) Int. Cl.[7] ..... B65D 25/40

(52) U.S. Cl. ..... 222/570; 220/254.3; 215/235; 222/1; 222/546; 222/556

(58) Field of Search ..... 222/1, 534, 546, 222/556, 570; 215/235, 306; 220/254.3, 837

(56) References Cited

U.S. PATENT DOCUMENTS

| | | | |
|---|---|---|---|
| 1,033,688 | A | 7/1912 | Fuchs |
| 1,033,689 | A | 7/1912 | Fuchs |
| 1,102,302 | A | 7/1914 | Slade |
| 1,173,546 | A | 2/1916 | Baron |
| 1,666,743 | A | 4/1928 | Klopsteg |
| 1,861,602 | A | 6/1932 | Koze |
| 1,925,926 | A | 9/1933 | Kunkel |
| 2,272,867 | A | 2/1942 | Cobel |
| 2,312,380 | A | 3/1943 | Bernhardt |
| 2,361,958 | A | 11/1944 | Nyden |
| 2,391,345 | A | 12/1945 | Punte |
| 2,474,678 | A | 6/1949 | Kitchen |
| 2,484,148 | A | 10/1949 | Beatty et al. |
| 2,574,422 | A | 11/1951 | Stoos, Jr. et al. |
| 2,575,106 | A | 11/1951 | Hermani |

(List continued on next page.)

FOREIGN PATENT DOCUMENTS

| | | |
|---|---|---|
| DE | 2120079 | 11/1972 |
| DE | 8815614 | 2/1989 |
| EP | 0087562 | 9/1983 |
| EP | 0591601 | 4/1994 |
| EP | 0626320 | 11/1994 |
| FR | 2317180 | 7/1975 |
| FR | 2609000 | 12/1986 |
| GB | 833270 | 9/1958 |
| GB | 4771 | 12/1976 |

*Primary Examiner*—Gene Mancene
*Assistant Examiner*—Melvin A Cartagena

(57) ABSTRACT

A dispenser package for a fluent product that includes a plastic container having an axially extending cylindrical neck, and a closure secured to the open end of the neck. The closure includes a plastic fitment having a dispensing opening and a cylindrical wall received within the neck. The container neck has a radially opening circumferential channel, while the fitment has a radially projecting circumferential bead received by snap fit into the channel to secure the fitment to the neck. A top is pivotally secured to the fitment or to the container neck for selectively opening and closing the dispensing opening. In the preferred embodiments of the invention, the dispensing opening is circular, and the top has an annular wall that forms a plug seal within the dispensing opening when the top is in the closed position. The top is flush with the fitment or the axial end of the container neck in the closed position to form a compact visual structure.

14 Claims, 4 Drawing Sheets

U.S. PATENT DOCUMENTS 2,694,511 A 11/1954 Bogaus et al.
2,762,537 A 9/1956 Reinhardt, Jr.
2,808,183 A 10/1957 Olson et al.
2,812,120 A 11/1957 Beall, Jr.
2,894,660 A 7/1959 Gordon
2,961,133 A 11/1960 Ankney
3,078,497 A 2/1963 Micallef
3,094,256 A 6/1963 Ensch
3,131,824 A 5/1964 Van Baarn
3,135,441 A 6/1964 Wise et al.
3,140,019 A 7/1964 Barr
3,157,322 A 11/1964 Bernhardt
3,201,011 A 8/1965 Brocken
3,209,963 A 10/1965 Krieps
D204,511 S 4/1966 Leeds et al.
3,251,509 A 5/1966 Foster
3,252,632 A 5/1966 Hagenes
3,262,606 A 7/1966 Waterman
3,300,104 A 1/1967 Burt
3,302,835 A 2/1967 Eckles
3,303,971 A 2/1967 Stevens, Jr.
3,371,827 A 3/1968 Micallef
3,377,005 A 4/1968 Marder
3,383,019 A 5/1968 Waterman
3,400,866 A 9/1968 Fattori
3,429,488 A 2/1969 Micallef
3,469,739 A 9/1969 Phillips
3,471,066 A 10/1969 Micallef
3,484,027 A 12/1969 Micallef
3,516,581 A 6/1970 Micallef
3,539,075 A 11/1970 Bautista
3,542,256 A 11/1970 Waterman
3,604,585 A 9/1971 Towns
3,642,179 A 2/1972 Micallef
3,653,546 A 4/1972 Hazzard
D223,602 S 5/1972 Hoffmann
3,659,756 A 5/1972 Lancaster
D224,092 S 7/1972 Steidley
3,675,804 A 7/1972 Micalif
3,675,812 A 7/1972 Foster
3,702,165 A 11/1972 Carow et al.
3,718,239 A 2/1973 Cochran
3,734,359 A 5/1973 Waterman
3,771,685 A 11/1973 Micallef
3,773,232 A 11/1973 Hidding
3,785,528 A 1/1974 Mandeltort
3,847,313 A 11/1974 Micallef
3,853,250 A 12/1974 Alpern
3,872,996 A 3/1975 Dogliotti
D236,880 S 9/1975 Sway
3,927,805 A 12/1975 Stull
3,948,422 A 4/1976 Micallef
3,957,181 A 5/1976 Hazzard
3,966,080 A 6/1976 Bittel
3,967,764 A 7/1976 Hazard
4,006,836 A 2/1977 Micallef
4,015,756 A 4/1977 Beck
4,022,352 A 5/1977 Pehr
D245,225 S 8/1977 Lyons
4,106,672 A 8/1978 Tecco et al.
RE29,793 E 10/1978 Pehr
4,158,902 A 6/1979 Chernack et al.
4,219,138 A 8/1980 Hazard
4,220,248 A 9/1980 Wilson et al.
4,231,486 A 11/1980 Bock
4,284,200 A 8/1981 Bush
4,286,636 A 9/1981 Credle
4,291,818 A 9/1981 Nozawa et al.
4,301,949 A 11/1981 Palson et al.
RE30,861 E 2/1982 Krawagna
4,343,397 A 8/1982 Nozawa et al.
4,358,032 A 11/1982 Libit
4,371,095 A 2/1983 Montgomery et al.
4,377,247 A 3/1983 Hazard et al.
4,399,928 A 8/1983 Klingler
4,441,637 A 4/1984 Libit
4,487,342 A 12/1984 Shy
4,545,508 A 10/1985 Cribb, Jr. et al.
4,579,260 A 4/1986 Young et al.
4,598,839 A 7/1986 Dombroski et al.
4,625,898 A 12/1986 Hazard
4,645,086 A 2/1987 Rosenthal
4,678,107 A 7/1987 Ennis, III
4,727,999 A 3/1988 Gach
4,732,303 A 3/1988 Wang
4,776,501 A 10/1988 Ostrowsky
4,793,502 A 12/1988 Beck
4,801,054 A 1/1989 Nycz
4,815,616 A 3/1989 Silvenis
4,838,460 A 6/1989 Moore et al.
4,848,601 A 7/1989 Reil
4,861,541 A 8/1989 Kaminski et al.
4,911,635 A 3/1990 Kaminski et al.
4,962,869 A 10/1990 Gross et al.
4,978,035 A 12/1990 Morane et al.
4,982,882 A 1/1991 Gueret
5,022,566 A 6/1991 Song et al.
5,022,567 A 6/1991 Frazer
5,052,595 A 10/1991 Mon
5,054,662 A 10/1991 Santagiuliana
5,058,775 A 10/1991 Gross et al.
5,065,912 A 11/1991 Rosenthall
D325,164 S 4/1992 Cann et al.
5,105,989 A 4/1992 Gutkowski
5,123,561 A 6/1992 Gross
5,147,072 A 9/1992 Dirksing
5,192,005 A 3/1993 Zimmerman
5,193,704 A 3/1993 Kick
5,201,440 A 4/1993 Gross
5,213,235 A 5/1993 Miranda
5,236,107 A 8/1993 Spaanstra, Sr.
5,242,079 A 9/1993 Stephens et al.
5,259,538 A 11/1993 Tardif
5,279,451 A 1/1994 Mueller et al.
5,284,264 A 2/1994 Gross
5,314,093 A 5/1994 Gross et al.
5,341,960 A 8/1994 Lay
5,346,100 A 9/1994 Lay
D353,332 S 12/1994 Behm et al.
5,370,277 A 12/1994 Wallis
5,370,284 A * 12/1994 Dirksing ..... 222/534
5,377,882 A 1/1995 Pham et al.
5,464,111 A 11/1995 Vacek et al.
5,482,172 A 1/1996 Braddock
5,544,790 A 8/1996 Lu
5,579,961 A 12/1996 Zimmerman
5,662,245 A 9/1997 Grant
5,813,554 A 9/1998 Marangoni Graziani
6,073,805 A 6/2000 Gueret

* cited by examiner

DISPENSER PACKAGE FOR FLUENT PRODUCTS AND METHOD OF MANUFACTURE

This application is a division of application Ser. No. 09/383,165 filed Aug. 24, 1999, now U.S. Pat. No. 6,394,323.

The present invention is directed to dispenser packages for fluent products such as cosmetics and body lotions, and more particularly to a dispenser package and method of manufacture in which the dispensing closure is closely integrated in contour and structure with the package container.

BACKGROUND AND SUMMARY OF THE INVENTION

It is a general object of the present invention to provide a dispenser package and method of manufacture for fluent products, such as cosmetics and body lotions, which obtain reduced manufacturing and inventory cost by reducing the number and complexity of component parts and/or by improved ease of assembly. Another and related object of the present invention is to provide a dispenser package and method of manufacture having improved visual impact in terms of closely blending the closure structurally and by contour with the design of the package container.

A dispenser package for a fluent product in accordance with one aspect of the present invention includes a plastic container having an axially extending cylindrical neck, and a closure secured to the open end of the neck. The closure includes a plastic fitment having a dispensing opening and a cylindrical wall received within the container neck. Either the container neck or the fitment wall has a radially opening circumferential channel, while the other has a radially projecting circumferential bead received by snap fir into the channel to secure the fitment to the container neck. A top is movably secured to the fitment or to the neck for selectively opening and closing the dispensing opening. In the preferred embodiments of the invention, the dispensing opening is circular, and the top has an annular wall that forms a plug seal within the dispensing opening when the top is in the closed position. The top in the preferred embodiments of the invention is pivotally secured to the fitment or the container neck, and is flush with the fitment or the axial end of the neck in the closed position to form a visually compact structure.

In the preferred embodiments of the invention, the bead is disposed on the closure fitment, and has a frustoconical sidewall for cam-centering the fitment within the neck during assembly of the fitment to the container neck. The neck may also include at least one axial channel, and preferably diametrically opposed axial channels, that extend from the circumferential channel to the open end of the neck. The fitment in accordance with this aspect of the invention includes at least one lug, and preferably diametrically opposed lugs, for receipt in the axial channel(s) as the fitment is inserted into the container neck for circumferentially aligning the fitment with respect to the neck. The top may be integrally molded with the fitment and secured to the fitment by an integral hinge, or may be formed separately from the fitment with spherical lugs that are received within spherical pockets on the container neck or the fitment. In different embodiments of the invention, the fitment may have a radial ledge that overlies a planar edge of the neck, or the fitment may be telescopically entirely received within the container neck so that the top is flush with the axial edge of the container neck in the closed position of the top.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
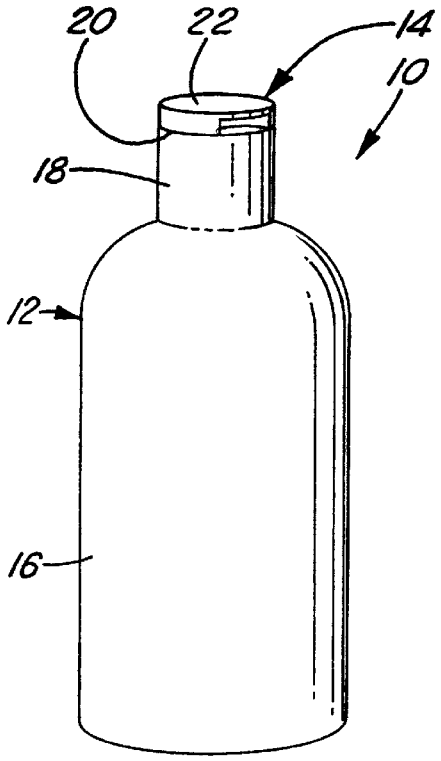
FIG. 1 is a perspective view of a dispenser package in accordance with one presently preferred embodiment of the invention.
Figure 2:
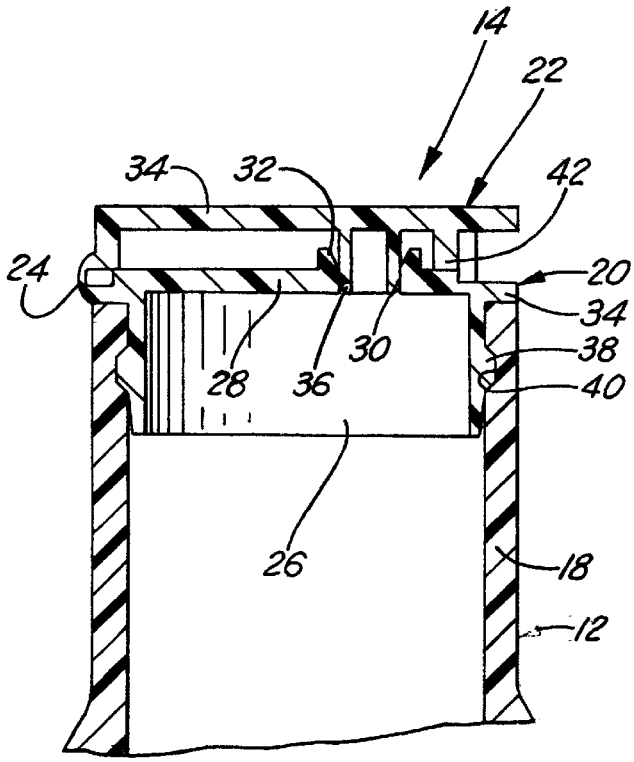
FIGS. 2 and 3 are fragmentary sectional views of the neck portion of FIG. 1 on an enlarged scale and showing the container closure in the closed and open positions respectively.
Figure 3:
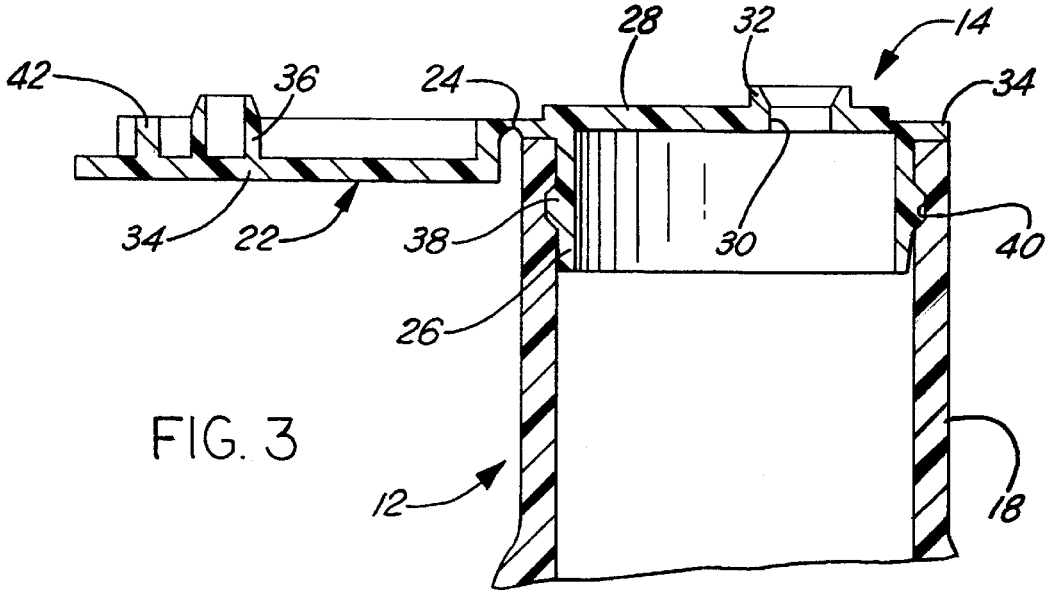
Figure 4:
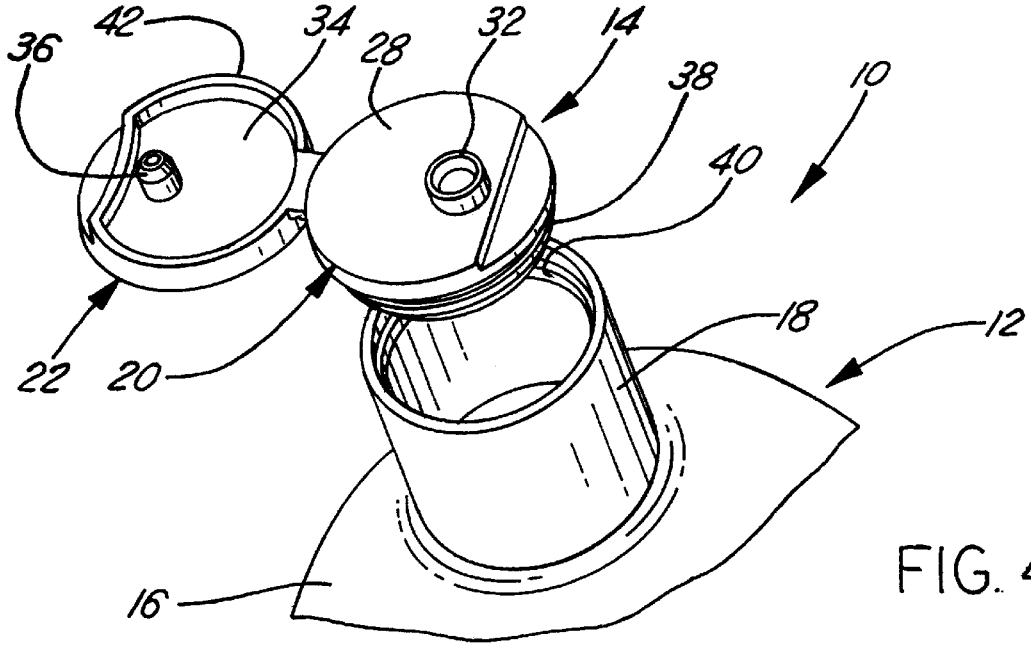
FIG. 4 is a fragmentary exploded perspective view of the package illustrated in FIGS. 1–3.

FIGS. 1–4 illustrate a dispenser package 10 in accordance with one presently preferred embodiment of the invention as comprising an integrally molded container 12 to which a closure 14 is secured. Container 12 includes a body 16 from which a cylindrical neck 18 projects. Body 16 and neck 18 may be integrally formed in a blow-molding or other suitable operation from suitable plastic resin composition(s). At least body 16 is preferably of flexible construction for squeezing to dispense the product. In the illustrated embodiment of the invention, container body 16 is of generally cylindrical contour, and neck 18 integrally projects from body 16 coaxially with the body.

Closure 14 in this embodiment of the invention comprises a fitment 20 and a circular top 22 pivotally secured to fitment 20 by an integrally formed hinge 24. Closure 14 is preferably of injection molded plastic construction. Fitment 20 includes a cylindrical wall 26 that is telescopically received within container neck 18. A flat wall 28 on fitment 20 has a circular dispensing opening 30 defined by an axially extending wall 32, and has a radially outwardly projecting ledge 34 that overlies the planar upper edge of neck 18. Top 22 includes a flat wall 34 secured to hinge 24, and an annular wall 36 projecting from flat wall 34 for receipt into dispensing opening 30 in the closed position of the closure (FIGS. 1 and 2) to form a plug seal within opening 30.

Fitment wall 26 has a radially outwardly projecting circumferential bead 38 that is received by snap fit within a circumferentially extending radially inwardly opening channel 40 of complementary contour on the inner surface of container neck 18. Both bead 38 and channel 40 are defined by radially facing cylindrical wall surfaces and opposed frustoconical side surfaces. The lower frustoconical surface of bead 38 (in the orientation of FIG. 2), which is angled upwardly and outwardly, cams the edge of neck 18 radially outwardly as fitment 20 is assembled into neck 18 so as to center the fitment with respect to the neck and facilitate assembly of the fitment to the neck. Hinge 24 preferably comprises a snap-type hinge of conventional construction. A wall 42 extends from flat wall 34 of top 22 for opposed abutment with fitment wall 28 to form a compact low-profile closure structure in the closed position illustrated in FIGS. 1 and 2.

Figure 5:
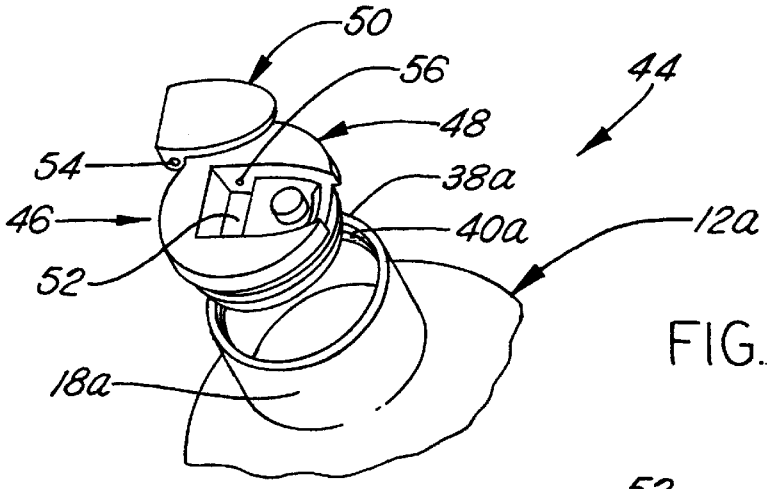
FIG. 5 is a fragmentary exploded perspective view of a dispenser package in accordance with a modified embodiment of the invention.
Figure 6:
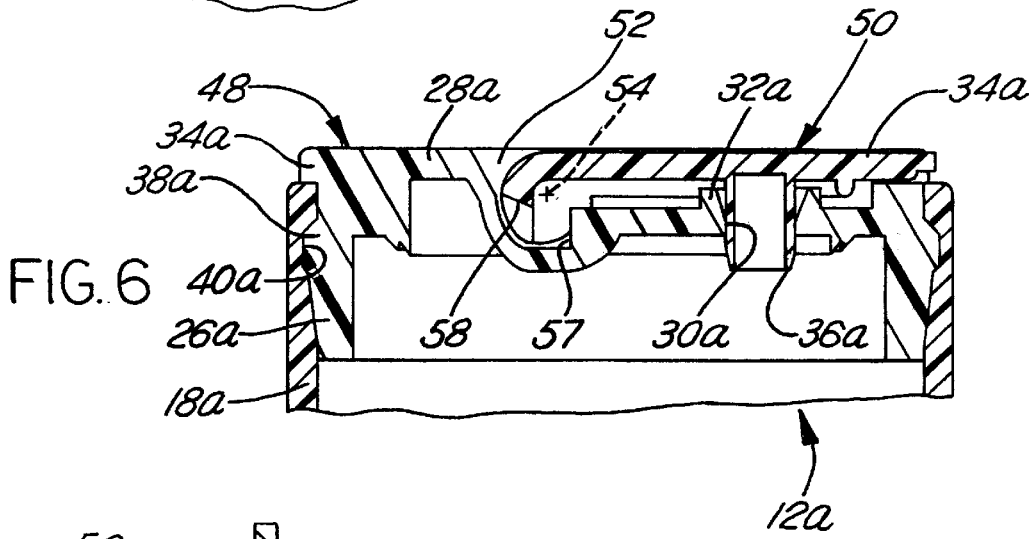
FIGS. 6 and 7 are fragmentary sectional views on an enlarged scale of the neck portion of the package illustrated in FIG. 5 with the closure in the closed and open positions respectively.
Figure 7:
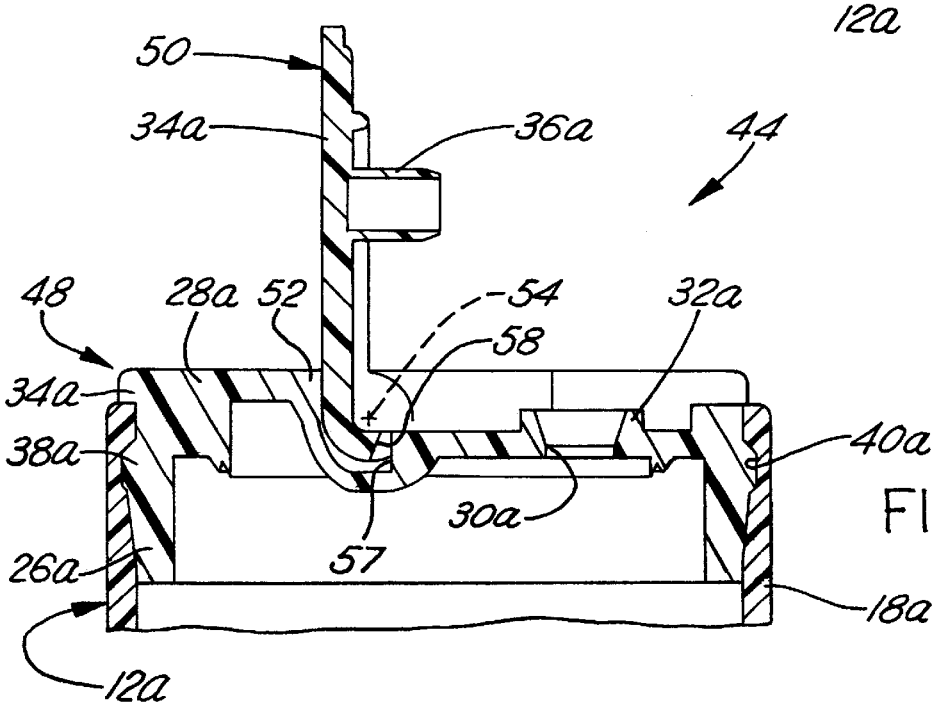

FIGS. 5–7 illustrate a dispenser package 44 in accordance with a modified embodiment of the invention. (Identical or related elements in the various drawings are indicated by identical reference numerals with a letter suffix.) Closure 46 in the embodiment of FIGS. 5–7 includes a fitment 48 and a spade-shaped top 50 formed separately from the fitment. As in the embodiment of FIGS. 1–4, fitment 48 includes a cylindrical wall 26*a* with a radially outwardly projecting circumferential bead 38*a*. Container 12*a* has a cylindrical neck 18*a* with a corresponding radially inwardly opening circumferential channel 40*a*. The base wall 28*a* of fitment 48 includes a dispensing opening 30*a* defined in part by an annular wall 32*a*, and has a radially projecting ledge 34*a* that partially overlies the planar axial edge of neck 18*a*. Fitment wall 28*a* also has a recessed pocket 52 that surrounds dispensing opening 30*a*. Top 50 has a pair of laterally projecting part-spherical nubs 54 that are pivotally received within corresponding part-spherical pockets 56 in fitment pocket 52. Thus, top 50 is freely pivotal about the axis of nubs 54 and pockets 56 between the closed position of FIG. 6 in which top 50 is flush with the top surface of fitment 48, and the fully open position illustrated in FIG. 7 in which top 50 is pivoted away from dispensing opening 30*a* in order to dispense product. A wall surface 57 within fitment pocket 52 cooperates with an opposing edge 58 of top 50 to function as a stop against opening of top 50 (counterclockwise in FIG. 7).

Figure 8:
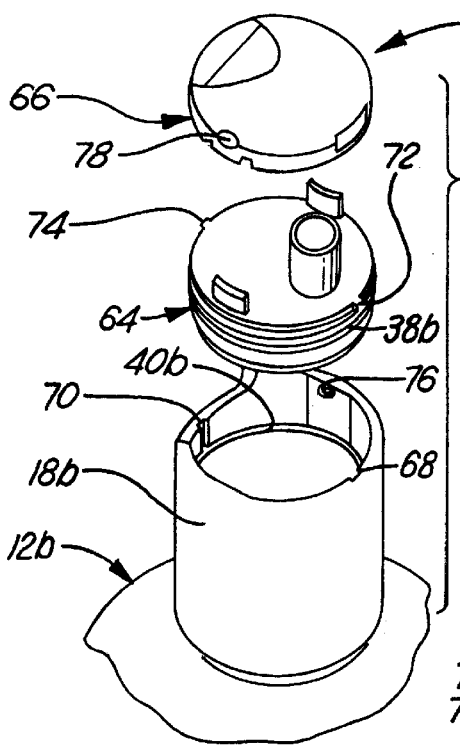
FIG. 8 is a fragmentary exploded perspective view of a dispenser package in accordance with another modified embodiment of the invention.
Figure 9:
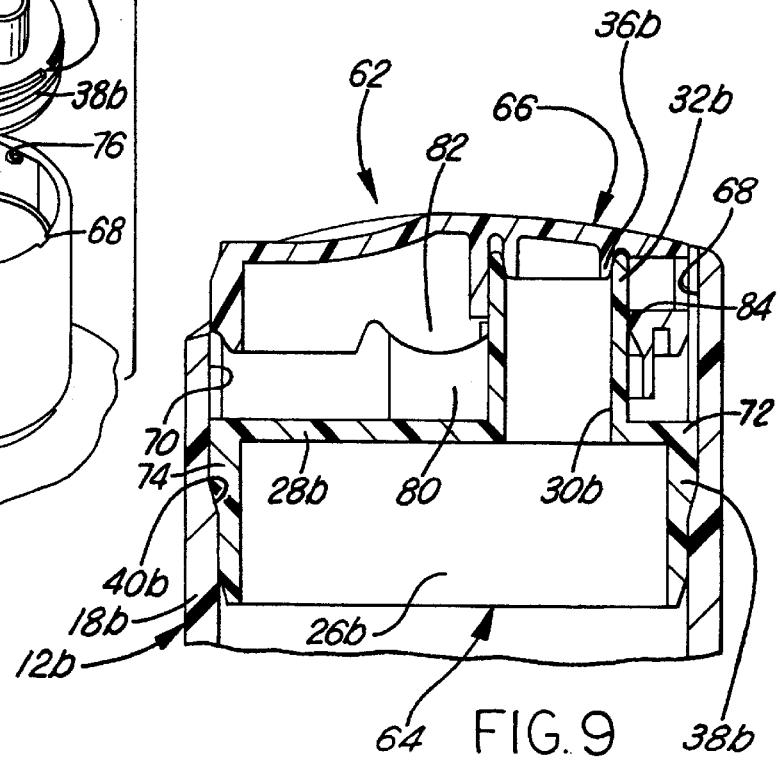
FIGS. 9 and 10 are fragmentary sectional views on an enlarged scale of the neck portion of the package in FIG. 8 with the closure in the closed and open positions respectively.
Figure 10:
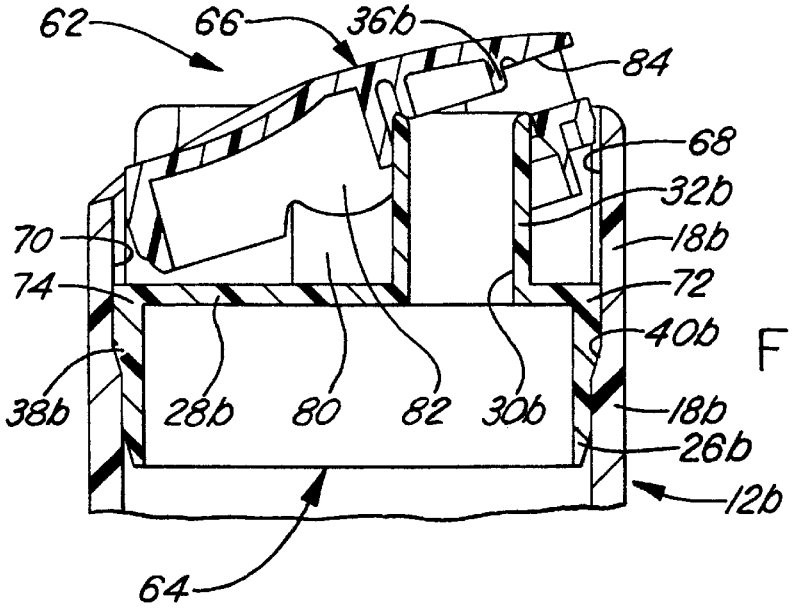

FIGS. 8–10 illustrate a dispenser package 60, in which the closure 62 comprises a fitment 64 and a separately formed disc-shaped top 66. Neck 18*b* of container 12*b* has a radially inwardly opening circumferential channel 40*b* as in the prior embodiments. A pair of diametrically opposed axial channels 68, 70 extend from circumferential channel 40*b* to the axial edge of neck 18*b* along the inner surface of the neck. Fitment 64 has a radially outwardly projecting circumferential bead or rib 38*b* that is received in assembly within channel 40*b* as in the prior embodiments. Fitment 38*b* also includes a pair of diametrically opposed nubs 72, 74 that project axially from bead 38*b* for receipt in axial channels 68, 70 of neck 18*b* as fitment 64 is assembled to container 12*b*. These axial nubs and channels align fitment 64 circumferentially with respect to neck 18*b*. A pair of diametrically opposed part-spherical pockets 76 are formed on the inner surface of neck 18*b* above channel 40*b* for receiving a pair of corresponding diametrically opposed part-spherical nubs 78 on disc top 66. Thus, in this embodiment, disc top 66 is pivotally secured to container neck 18*b* over fitment 64, as distinguished from being pivotally secured to the fitment itself as in the embodiments of FIGS. 1–7. Fitment 64 has a diametrically opposed pair of concave part-circular axial shoulders 80 that pivotally support a pair of convex part-circular bearing ledges 82 on disc top 66. These bearings help support the disc top as it is pivoted between the closed and open positions of FIGS. 9 and 10. When disc top 66 is pivoted to the open position of FIG. 10, plug seal wall 36*b* of disc top 66 clears annular wall 32*b* on fitment 64, which partially defines dispensing opening 36*b*, so that the fluent product within the container may be dispensed through the lateral opening 84 in disc top 66. When disc top 66 returned to the closed position of FIG. 9, opening 84 is beneath the edge of neck 18*b*, and disc top wall 36*b* forms a plug seal within dispensing opening 30*b*. Disc top 66 is generally flush with the upper edge of neck 18*b* in the closed position.

There have thus been disclosed a dispensing package and method of assembly that fully achieve the objects and aims previously set forth. Several modifications and variations have been disclosed. Other modifications and variations will readily suggest themselves to persons skilled in the art. The invention is intended to encompass all modifications and variations that fall within the spirit and broad scope of the appended claims.

What is claimed is:

1. A method of making a dispenser package for a fluent product, which comprises the steps of:

(a) integrally molding a plastic container having an axially extending cylindrical neck with an edge, a circumferential channel around an inside surface of said neck spaced from said edge, and at least one axial channel extending from said circumferential channel to said edge, (b) providing a plastic fitment having a dispensing opening and a cylindrical wall with a radially outwardly extending bead, and at least one lug for receipt in said axial channel, (c) securing said fitment to said neck by inserting said fitment into said neck until said bead snaps into said circumferential channel, receipt of said lug in said axial channel aligning said fitment circumferentially with respect to said neck, and (d) pivotally securing a top to said neck or said fitment for selectively opening and closing said dispensing opening.

2. The method set forth in claim 1 wherein said step (b) includes providing said bead with a frustoconical surface to cam-center said fitment within said neck during said step (c).

3. The method set forth in claim 1 wherein said steps (b) and (d) are carried out simultaneously by molding said top integrally with said fitment.

4. The method set forth in claim 1 wherein step (d) is carried out by providing part-spherical nubs on said top, providing part-spherical pockets on one of said neck and said fitment, and snapping said nubs into said pockets.

5. The method set forth in claim 1 wherein said top is provided with an annular wall for plug sealing engagement with said dispensing opening.

6. The method set forth in claim 1 wherein said step (b) includes providing a ledge on said fitment that overlies said edge following said step (c).

7. The method set forth in claim 1 wherein said step (a) includes providing diametrically opposed axial channels in said neck, and said step (b) includes providing diametrically opposed lugs on said cylindrical wall that are received in said axial channels in said step (c).

8. A dispenser package for a fluent product, which comprises:

a plastic container having an axially extending cylindrical neck with a radially inner neck surface, a radially outer neck surface, and an axial edge disposed in a plane and extending between said inner and outer neck surfaces, a fitment of one-piece integrally molded plastic construction having a dispensing opening, a cylindrical wall received within said neck with an outer wall surface opposed to said radially inner neck surface, and a radial ledge overlying said axial edge of said neck and terminating at said outer neck surface, one of said inner neck surface and said outer wall surface having a radially opening circumferential channel and the other of said inner neck surface and said outer wall surface having a radially projecting circumferential bead received in said channel to secure said fitment to said neck, and a top movably secured to said fitment or neck for selectively opening and closing said dispensing opening.

9. The package set forth in claim 8 wherein said bead is disposed on said fitment and said channel is disposed on said neck.

10. The package set forth in claim 9 wherein said bead and said channel each have a radially facing base wall and frustoconical sidewalls.

11. The package set forth in claim 8 wherein said neck includes at least one axial channel extending from said circumferential channel to said axial edge, and wherein said fitment has at least one axial lug extending from said bead into said axial channel for aligning said fitment circumferentially with respect to said neck.

12. The package set forth in claim 11 wherein said neck has diametrically opposed axial channels and said fitment has diametrically opposed axial lugs disposed in said channels.

13. A method of making a dispenser package for a fluent product, which comprises the steps of:

(a) integrally molding a plastic container having an axially extending cylindrical neck with an edge, a circumferential channel with a frustoconical surface around an inside surface of said neck spaced from said edge, and at least one axial channel in said neck extending from said circumferential channel, (b) providing a plastic fitment having a dispensing opening, a cylindrical wall with a radially outwardly extending bead having a frustoconical surface, and at least one lug for receipt in said axial channel, (c) securing said fitment to said neck by inserting said fitment into said neck until said bead snaps into said circumferential channel and said lug is received in said axial channel to align said fitment circumferentially with respect to said neck, said frustoconical surfaces functioning to cam-center said fitment within said neck during said step (c), and (d) pivotally securing a top to said neck or said fitment for selectively opening and closing said dispensing opening.

14. A method of making a dispenser package for a fluent product, which comprises the steps of:

(a) integrally molding a plastic container having an axially extending cylindrical neck with an edge, a circumferential channel around an inside surface of said neck spaced from said edge, and at least one axial channel in said neck extending from said circumferential channel, (b) providing a plastic fitment having a dispensing opening, a cylindrical wall with a radially outwardly extending bead and at last one lug for receipt in said axial channel, (c) securing said fitment to said neck by inserting said fitment into said neck until said bead snaps into said circumferential channel and said lug is received in said axial channel to align said fitment circumferentially with respect to said neck, and (d) pivotally securing a top to said neck or said fitment for selectively opening and closing said dispensing opening.

* * * * *